US005560410A

United States Patent [19]

Peacock

[11] Patent Number: 5,560,410

[45] Date of Patent: Oct. 1, 1996

[54] VENEER DRYING APPARATUS AND METHOD

[76] Inventor: Anthony N. Peacock, 2414 Holly St., Jacksonville, Tex. 75766

[21] Appl. No.: 321,399

[22] Filed: Oct. 11, 1994

[51] Int. Cl.[6] ..... B27M 1/02

[52] U.S. Cl. ..... 144/362; 34/70; 34/398; 100/41; 100/176; 144/329; 144/245.5; 144/2.1

[58] Field of Search ..... 34/70, 205, 380, 34/398; 100/41, 121, 176, 98 R; 144/2 R, 329, 245 R, 245 C, 362

[56] References Cited

U.S. PATENT DOCUMENTS

| | | | |
|---|---|---|---|
| 128,387 | 6/1872 | Gyles . | |
| 1,969,712 | 8/1934 | Helffrich . | |
| 2,323,918 | 7/1943 | Kiernan | 34/70 |
| 2,830,004 | 4/1958 | Lyons . | |
| 3,183,606 | 5/1965 | Gustafsson et al. . | |
| 3,491,989 | 7/1968 | Fritz et al. . | |
| 3,557,466 | 1/1971 | Bodine . | |
| 4,051,882 | 10/1977 | Hasegawa | 144/329 |
| 4,473,099 | 9/1984 | Koike et al. | 144/362 |
| 4,614,045 | 9/1986 | Nagasawa et al. | 34/34 |
| 4,691,629 | 9/1987 | Koba | 144/362 |
| 4,718,338 | 1/1988 | Koba | 144/362 |
| 4,790,360 | 12/1988 | Clarke et al. | 144/362 |
| 4,945,652 | 8/1990 | Clarke et al. | 34/12 |
| 5,179,986 | 1/1993 | Beuving et al. | 144/362 |
| 5,234,040 | 8/1993 | Koba | 144/362 |

FOREIGN PATENT DOCUMENTS

| | | | |
|---|---|---|---|
| 927590 | 6/1973 | Canada | 34/4 |

*Primary Examiner*—W. Donald Bray
*Attorney, Agent, or Firm*—Baker & Botts, L.L.P.

[57] ABSTRACT

A system (10) for processing veneer is provided. The system (10) includes a compression apparatus (12) having a first set of rollers (20) turning at a first rate and has a first clearance (96) therebetween, and a second set of rollers (22) turning at a second rate and has a second clearance (98) therebetween. The first and second roller rates are substantially equal. The system also includes a feeder (16). The feeder (16) includes a hopper (62) for holding a plurality of veneer slats (82) and a feeder mechanism for feeding the slats one at a time into the compression apparatus. The system may have a first drive mechanism (14) for turning the first (20) and second (22) rollers and a second drive mechanism for driving the feeder mechanism. Moisture is removed from a veneer slat (92) by feeding the veneer slat (92) into the first turning roller set (20) and compressing the veneer slat (92) to the first clearance (96) in the first roller set and into the second turning roller set (22) and compressing the veneer slat (92) to the second clearance (98) in the second roller set (22).

52 Claims, 6 Drawing Sheets

VENEER DRYING APPARATUS AND METHOD

TECHNICAL FIELD OF THE INVENTION

This invention relates in general to the field of drying veneer, and more particularly, to an improved method and apparatus for drying veneer slats.

BACKGROUND OF THE INVENTION

Wood products are generally classified according to the thickness of the wood. Wood products two inches thick and greater, e.g., a two-by-four, are classified as lumber. Wood products less than two inches thick but greater than one inch thick, e.g., a one-by-six, are classified as boards. Veneer sheets or slats are those wood products that are less than one inch thick. (It is noted that a two inch thick piece of lumber has an actual finished thickness of one and one-half inches, while a one inch thick board has an actual finished thickness of three-quarter inches.)

Because of the uses for, processing of, and structure of these classes of wood products, they are generally viewed as separate industries. Additionally, it has generally been observed that methods for processing lumber or boards may not be technically possible or economically feasible when processing veneer, and vice versa. For example, prior attempts to compress the moisture out of lumber have been unsuccessful. Lumber dried by prior compression techniques results in damaged pieces that are not usable.

Cutting veneer from timber occurs primarily by one of two techniques; rotary cutting and slice cutting. Rotary cut veneer is cut from a rotating log by applying a cutting edge to the log so that layers of the log are removed. Slice cutting veneer involves slicing a log from one end through its longitudinal axis to its second end. The number of slats or sheets that may be taken from a piece of timber depends on the width of each piece of veneer. In the veneer industry, the thickness of veneer is expressed in the number of slats to the inch. For example, "ten to the inch," is ten slats each 0.1 inch thick.

Veneer must be dried following cutting to lower its moisture content before it can be used. A freshly cut piece of veneer may have a moisture content as high as 90%. The moisture content of a usable piece of veneer should be below 30%.

A previously developed method for drying veneer may include placing the veneer in a kiln or drying oven. Typically, veneer pieces are laid flat on a conveyor or rack system within the drying oven. Alternatively, the veneer pieces may be fed through a series of rollers that are both above and below the veneer in the oven. The rollers hold the veneer flat while it is being dried in the oven. Heat draws the moisture out of the veneer. Drying veneer in this manner can be a very difficult process. If the veneer is dried too quickly or at too high a temperature, moisture in the veneer will turn to steam that may damage the cell structure of the veneer. Veneer with a damaged cell structure lacks the strength necessary to be useful.

Previously developed methods for drying veneer may require extensive time in order to dry the veneer. It is not uncommon for these prior methods to require at least 30 minutes to dry the veneer. The cost of heating the oven, as well as the labor to load and unload the oven, add to the veneer's cost.

Another prior method for drying veneer includes placing the veneer pieces between heated plates and then applying heat and pressure to the veneer. Unfortunately, this method suffers from all the disadvantages of any heat drying technique. It is difficult to control, slow, expensive, and labor intensive.

Compression techniques for squeezing out the moisture in veneer have been previously developed. These previous methods involve compressing a veneer slat with a compressive force generated by two sets of rollers turning at different speeds along the length of the slat. This technique can damage the veneer and cause it to buckle. Additionally, it may not remove sufficient moisture and often requires additional heat drying.

SUMMARY OF THE INVENTION

In accordance with the present invention, a veneer drying apparatus and method are provided that substantially eliminate or reduce disadvantages and problems associated with previously developed veneer drying systems.

One aspect of the present invention provides an apparatus for processing veneer. The apparatus includes a first set of rollers turning at a first rate and having a first clearance. The apparatus also includes a second set of rollers turning at a second rate and having a second clearance. The first and second roller rates are substantially equal. Moisture is removed from the veneer by feeding the veneer into the first turning roller set and compressing the veneer to the first clearance in the first roller set and by feeding the veneer into the second turning roller set and compressing the veneer to the second clearance in the second roller set.

Another aspect of the present invention provides a method for processing veneer. The method includes turning a first set of rollers at a first rate. The first roller set has a first clearance therebetween. The method also includes turning a second set of rollers at a second rate. The second roller set also has a second clearance therebetween. The first and second roller rates are substantially equal. The method further includes feeding the veneer into the first turning roller set and compressing the veneer to the clearance in the first roller set and feeding the veneer into the second turning roller set and compressing the veneer to the clearance in the second roller set so as to compress moisture out of the veneer.

Another aspect of the present invention provides a system for processing veneer. The system includes a compression apparatus having a first set of rollers turning at a first rate and having a first clearance therebetween and a second set of rollers turning at a second rate and having a second clearance therebetween. The first and second roller rates are substantially equal. The system also includes a feeder. The feeder includes a hopper for holding a plurality of veneer slats and a feeder mechanism for feeding the slats one at a time into the compression apparatus. The system may have a first drive mechanism for turning the first and second rollers and a second drive mechanism for driving the feeder mechanism. Moisture is removed from a veneer slat by feeding the veneer slat into the first turning roller set and compressing the veneer slat to the first clearance in the first roller set and into the second turning roller set and compressing the veneer slat to the second clearance in the second roller set.

Yet another aspect of the present invention provides a method for processing veneer. The method includes loading a feeder with plurality of veneer slats. The method further includes turning a first set of rollers at a first rate and turning a second set of rollers at a second rate. The first and second roller sets have a clearance therebetween, and the first and second roller rates are substantially equal. The method further includes automatically feeding the veneer slats from the feeder into the first turning roller set and compressing the veneer to the clearance in the first roller set and to the clearance in the second roller set so as to compress moisture out of the veneer.

The present invention provides numerous technical advantages. A key technical advantage of the present veneer drying system is the speed at which it may dry veneer. The present invention can dry up to six veneer slats per second as opposed to the 30 minutes for each veneer slat required with traditional oven drying techniques.

Another technical advantage of the present invention is the labor savings it can provide. Currently available conventional drying systems require manpower to load and unload the veneer into the dryer. The present veneer drying apparatus and method utilizes an automatic loading system that minimizes handling of the veneer. This helps reduce the cost of the veneer.

Because the present invention eliminates the need for a heat source in order to dry the veneer, it provides a technical advantage of eliminating the cost for the fuel for the heat source. This helps minimize the cost of veneer processed in accordance with the present invention. Alternatively, the present invention can be used in conjunction with conventional heat drying techniques. Because the present invention removes a large portion of the moisture in the veneer, the amount of time required in a drying oven after processing with the present invention is minimized.

Yet another technical advantage of the present invention is its easy operation and rugged construction. The present invention accommodates different sizes of veneer and is built from readily available hardware minimizing its procurement cost.

BRIEF DESCRIPTION OF THE DRAWINGS

For a more complete understanding of the present invention and advantages thereof, reference is now made to the following description taken in conjunction with the accompanying drawings in which like reference numbers indicate like features and wherein.

DETAILED DESCRIPTION OF THE INVENTION

Preferred embodiments of the present invention are illustrated in the figures, like numerals being used to refer to like and corresponding parts of the various drawings.

Figures 1, 11, 12A, 12B:
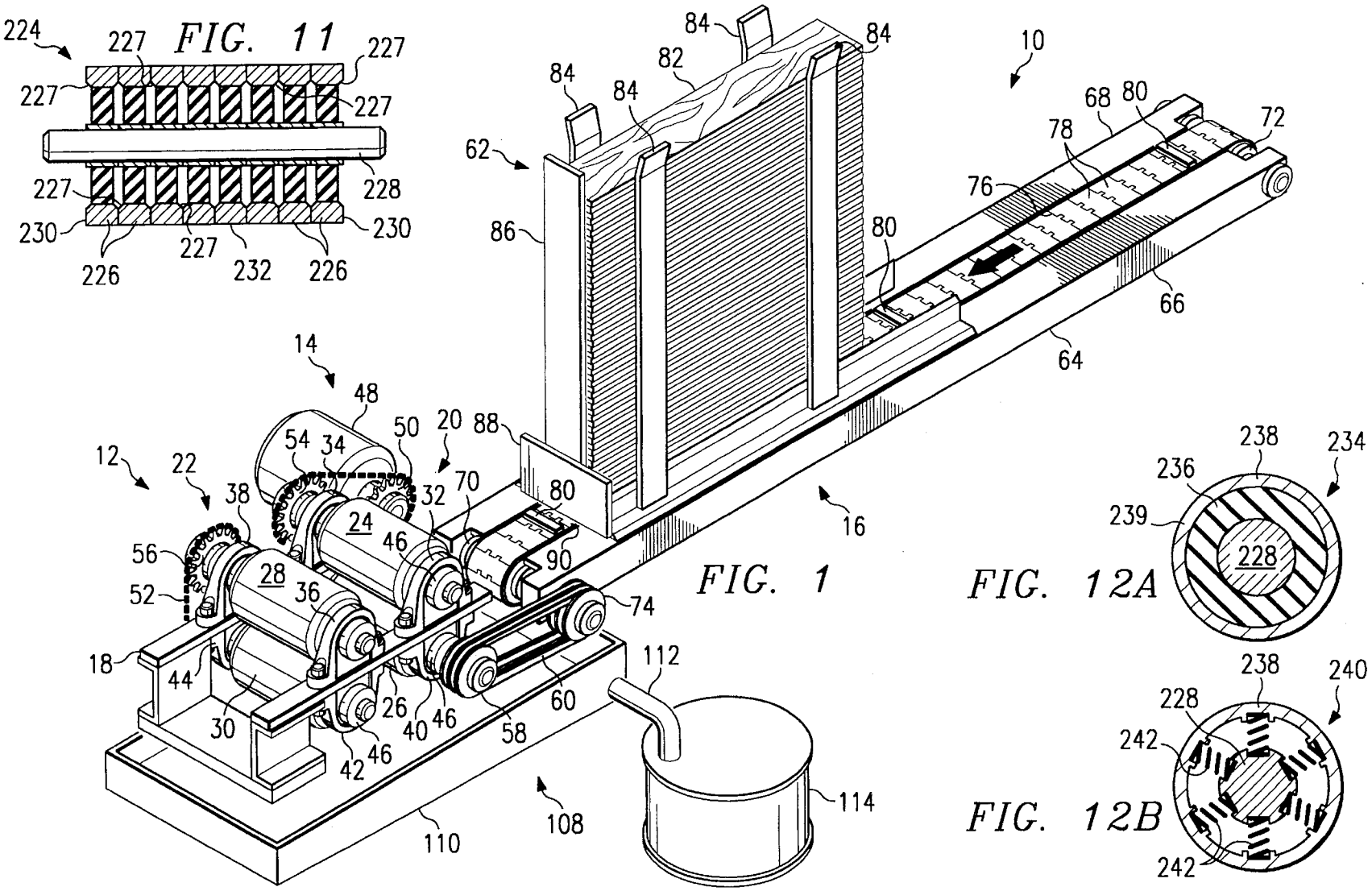
FIG. 1 shows in perspective and in elevation a veneer drying system in accordance with concepts of the present invention.
FIG. 11 depicts in perspective and elevation a segmented roller that may be used for the rollers in the present veneer drying system.
FIGS. 12A and 12B show in cross-section with portions broken away configurations for the segmented roller of FIG. 11.

FIG. 1 shows veneer drying system 10 including compression apparatus 12, drive mechanism 14, and feeder 16. Veneer drying system 10 represents one embodiment of the present invention for drying veneer slats. Compression apparatus 12 is supported by support structure 18. Support structure 18 would be appropriately secured to ensure the stability of system 10. Compression apparatus 12 includes two sets of compression rollers including in-take rollers 20 and out-take rollers 22. In-take rollers 20 include top in-take roller 24 and bottom in-take roller 26. Out-take rollers 22 include top out-take roller 28 and bottom out-take roller 30.

Each roller in compression apparatus 12 may be formed from a solid piece of steel. A typical diameter for the rollers is on the order of 4½ inches. Alternatively, each roller can be a steel cylinder having walls on the order of ⅛ inch thick. The ends of each cylinder are sealed with a plate, and a shaft is secured through the center of each cylinder and to each end plate. Each end of the shaft is secured to an associated roller housing in a bearing. It is noted that the dimensions of the rollers can be modified without departing from the inventive concepts of the present invention.

Each of the rollers in compression apparatus 12 is supported in a roller housing coupled to support structure 18. Top in-take roller 24 is supported at a first end by roller housing 32 and at its second end by roller housing 34. In a similar manner, top out-take roller 28 is supported by roller housing 36 at its first end and roller housing 38 at its second end. In the view of FIG. 1, only roller housing 40 is shown for bottom in-take roller 26 as the other roller housing is hidden from view. Roller housings 42 and 44 are shown for bottom out-take roller 30. Each roller housing includes bearing 46 so that its associated roller turns with respect to the roller housing.

Drive mechanism 14 of veneer drying system 10 in FIG. 1 includes motor 48 having motor gear or sprocket 50. Motor 48 may be any commercially available high torque motor. Motor gear 50 engages chain 52 that in turn drives top in-take gear or sprocket 54. Chain 52 also drives bottom in-take roller 26, top out-take roller 28, (by top out-take gear or sprocket 56), and bottom out-take roller 30. It is noted that chain 52 can have several embodiments, including, but not limited to, a belt. Additional detail on drive mechanism 14 may be found in discussions relating to FIG. 3B.

Also part of drive mechanism 14 is first feeder drive gear 58 coupled to the shaft of bottom in-take roller 26 shown on the near side of FIG. 1. First feeder drive gear drives belt 60 that in turn drives feeder 16. In the configuration of veneer drying system 10 shown in FIG. 1, belt 60 is depicted as two drive belts, it being understood that one or more belts can be used. Additionally, it is noted that first feeder drive gear 58 may be embodied in a toothed pulley or sprocket and belt 60 may have protrusions to mate with the teeth on gear 58. In this embodiment, the teeth of belt 60 may be steel reinforced rubber. It is noted that chain 52 used to drive the rollers of compression apparatus 14 may be embodied in a belt having protrusions and the gears of compression apparatus 14 would be configured to mate with the protrusions on the belt in order to turn the rollers in this embodiment.

It is noted that in the embodiment of drive mechanism 14 of system 10 in FIG. 1, all of the gears or sprockets in drive mechanism 14 are identical providing a uniform turns ratio. This ensures that each of the gears and rollers within drive mechanism 14 are turning at the same speed. Additionally, this ensures that feeder 16 is operating at the same rate as compression apparatus 12. It is noted that the size of the gears or sprockets can be varied with respect to one another without departing from the inventive concepts of the present invention.

Feeder 16 includes hopper 62 and belt system 64. Belt system 64 includes first arm 66 and second arm 68 having belt roller 70 at one end and belt roller 72 at the other end between arms 66 and 68. Belt roller 70 includes second feeder gear 74 that is driven by belt 60 of drive mechanism 14. Feeder gear 74 is generally identical to the configuration of first feeder drive gear 58. Feeder gear 74 turns belt roller 70 so that feeder belt 76 moves with respect to hopper 62. Because first feeder gear 58 is identical to second feeder gear 74, feeder belt 76 turns at the same speed as the rollers within compression apparatus 12. Additionally, it is noted that in the preferred embodiment belt 60 is the type known in the art as a slip belt. Should compression apparatus 12 become jammed or otherwise non-operational, belt 60 will slip with respect to either first 58 or second 74 feeder gear to prevent additional slats from being fed into compression apparatus 12. Feeder belt 76 may be formed from connectable metal sections 78 and includes lugs 80 that engage the veneer slats in hopper 62. Alternatively, feeder belt 76 may be formed from durable fabric material having lugs 80 attached thereto. Additionally, feeder belt 76 may be formed of plastic sections 78 connected by steel link pins. Lugs 80 may be made of steel or other durable material.

Shown in FIG. 1 are veneer slats 82 loaded into hopper 62. Each slat may be on the order of 21 inches long and 3 inches wide. Hopper 62 may include hopper arms 84 and face plate 86 for supporting veneer slats 82. Bridge 86 is at the out-feed of hopper 62 and may be adjusted with respect to face plate 86 to ensure that only a single veneer slat of veneer slats 82 is fed at a time into compression apparatus 12.

Figure 2:
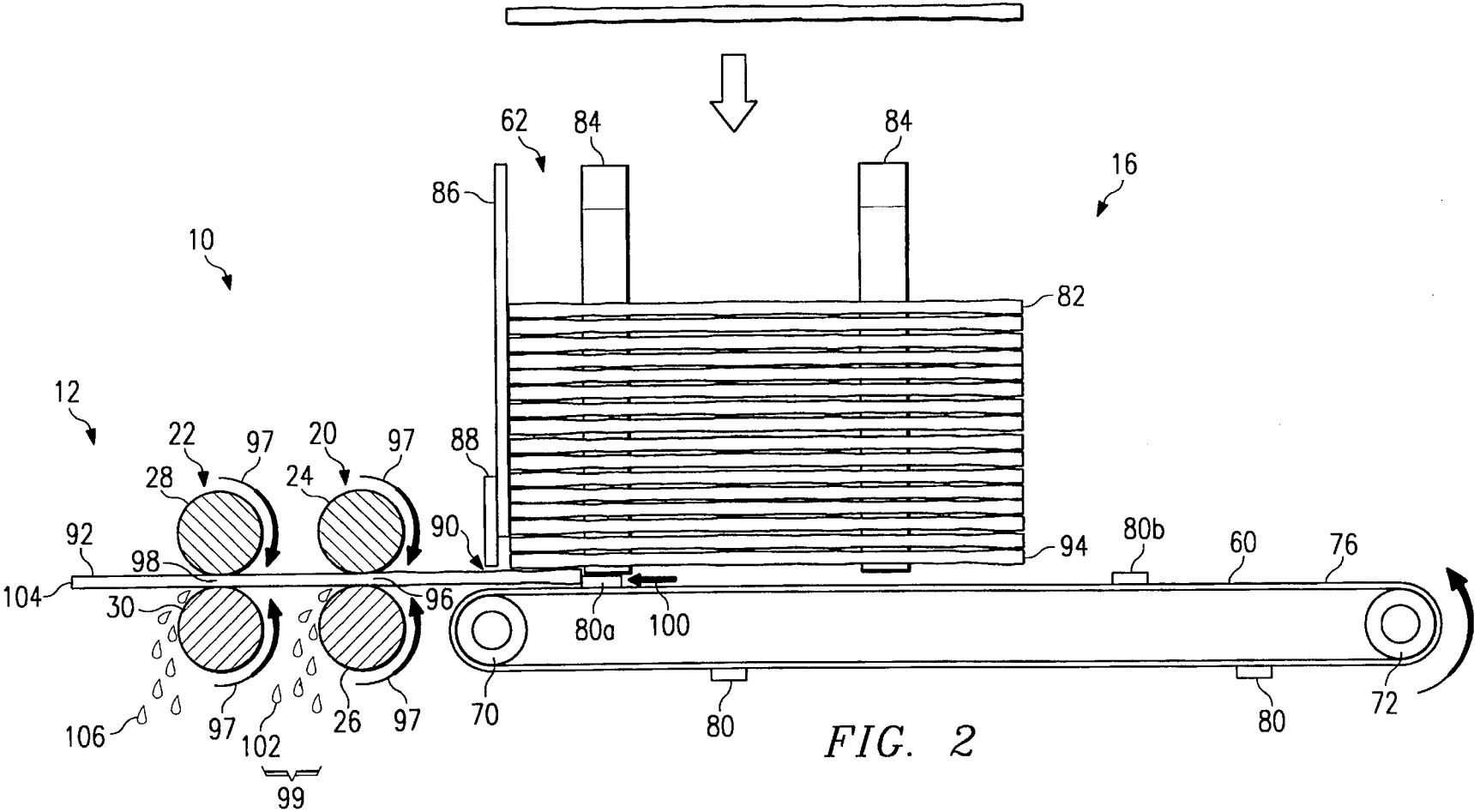
FIG. 2 is a side view of the present veneer drying system in operation.

FIG. 2 is a cross-sectional view of veneer drying system 10 of FIG. 1. FIG. 2 will be used to describe the operation of veneer drying system 10 incorporating concepts of the present invention. Veneer drying system 10 can be used for drying various species of veneer slats 82. Veneer drying system 10 has been found to be particularly suitable for drying Cottonwood and Sweetgum veneer slats. The clearance between the rollers is set based on the species of slats being dried. For example, it is known that Sweetgum slats must be compressed to approximately 0.06 inches, while Cottonwood slats must be compressed to approximately 0.04 inches.

Once the type of species of veneer slats 82 is determined, the thickness of each veneer slat must be ascertained. In order to ensure that only single veneer slat 92 from slats 82 is fed into compression apparatus 12, opening 90 between bridge 88 and belt 76 at first belt roller 70 must be set. For example, when using ten to the inch slats (0.1 inches per slat), opening 90 must be set at less than two times the width of each slat, i.e., <0.2 inches. In this way, when lug 80*a* engages single slat 92 as shown in FIG. 2, only slat 92 will fit through opening 90 and into compression apparatus 12. Next slat 94 is caught by bridge 88 preventing it from entering compression apparatus 12. By this way only a single veneer slat of the veneer slats in the feeder is fed into compression apparatus 12 at a time. This prevents compression apparatus 12 from jamming.

The clearance within each set of rollers must also be set for the type species and thickness of veneer slats to be processed. Between top in-take roller 24 and bottom in-take roller 26 is spacing or clearance 96, and between top out-take roller 28 and bottom out-take roller 30 is spacing or clearance 98. Continuing the example from above, for 0.1 inch thick slats, in order to compress the moisture out of slats 82, spacing 96 should be approximately 50% of the initial thickness of veneer slats 82. Therefore, for a 0.1 inch thick veneer slat, clearance 96 between rollers 24 and 26 should be set to approximately 0.05 inches. In order to ensure that the veneer slat is not damaged during this process, clearance 98 between rollers 28 and 30 should be set at equal to or slightly larger than clearance 96. When drying ten to the inch veneer slats 82 with clearance 96 set at 0.05 inches, it would be appropriate to set clearance 98 at approximately 0.06 inches. Also, clearances 96 and 98 cannot be set at too small a value for the thickness of the veneer to be dried else the veneer will be damaged.

Lateral spacing 99 between in-take rollers 20 and out-take rollers 22 should also be set so that edge 104 of veneer slat 92 is not allowed to drop when between rollers 20 and 22 so that it jams system 10. Also, in-take rollers 20 should generally be spaced 10 to 12 inches from feeder 16.

With opening 90 and clearances 96 and 98 set for the type of and thickness of veneer slats 82 in feed 16, drive mechanism 14 may be started. Engaging motor 48 causes motor gear 50 to turn and drive chain 52. Chain 52 drives the gears or sprockets on rollers 24, 26, 28 and 30 as shown and represented by arrows 97 in FIG. 2. Turning bottom in-take roller 30 also causes first feeder drive gear 58 to move drive belt 60. Belt 60, in turn, drives second feeder gear 74. Feeder gear 74 turns belt roller 70 causing feeder belt 76 of belt system 64 to be moved in the direction shown by arrow 100.

Moving belt 76 in the direction of arrow 100 causes lug 80*a* to engage single slat 92 in hopper 62. Lug 80*a* pushes single slat 92 forward through opening 90 under bridge 88 until it is engaged by in-take rollers 20. In-take rollers 20 provide a compression force that reduces the size of slat 92 to the size of clearance 96. This causes sap or sap and moisture 102 to be discharged from slat 92. Once end 104 exits in-take rollers 20, it will begin to expand. End 104 is then fed into out-take rollers 22 where it is compressed to the dimension of clearance 98. Sap or sap and moisture 106 is discharged from slat 92 by the compression force. Once slat 92 has cleared compression apparatus 12, next slat 94 will be engaged by next lug 80*b* on feeder belt 76 and forced through opening 90 and into compression apparatus 12. It is noted that the spacing of lugs 80 on belt 76 is such that only a single slat will be forced into compression apparatus 12 at a time.

FIGS. 1 and 2 demonstrate several technical advantages of the present invention. The configuration of veneer drying system 10 depicted in FIGS. 1 and 2 has been operated with roller speeds at up to approximately 1800 RPMs or higher. At this rate system 10 dries up to six of veneer slats 82 per second. This equates to 360 slats per minute and 21,600 slats per hour. The present veneer drying system, therefore, dries veneer slats much faster than prior art kiln or oven drying systems. Veneer slats dried in system 10 generally have a moisture content sufficiently low that no additional drying is necessary. Veneer slats dried with system 10 have been found to be suitable for use as box veneer cottonwood species. When additional moisture removal is required, the slats can be dried in a conventional heat drying system. Since the majority of the moisture has been removed, the time and expense associated with the heat drying system can be reduced. Additionally, because feeder 16 automatically feeds compression apparatus 12, the manpower required to dry slats is reduced over prior art veneer drying systems. Also, while veneer slats 82 in hopper 62 may have nonuniform thicknesses, once they are compressed in compression apparatus 12 the slats generally have a uniform thickness.

FIG. 1 also shows collection system 108 for collecting the sap or sap and moisture represented by 102 and 106 in FIG. 2. Collection system 108 includes pan 110 into which moisture 102 and 106 fall. Hose 112 drains the moisture from pan 110 into storage 114. When veneer drying system 10 is used to dry Sweetgum veneer slats, the sap or sap and moisture from the Sweetgum slats can be collected in collection system 108. Sweetgum sap can be distilled to the product known as storax.

It is noted that the illustrations and related descriptions provided above for the present veneer drying system are provided by way of example only of an embodiment for the present invention. The present invention is not limited to drying only the species or width of veneer slats described. The present invention is suitable for drying veneer slats with thicknesses up to four to the inch (0.25 inch each).

Figure 3A:
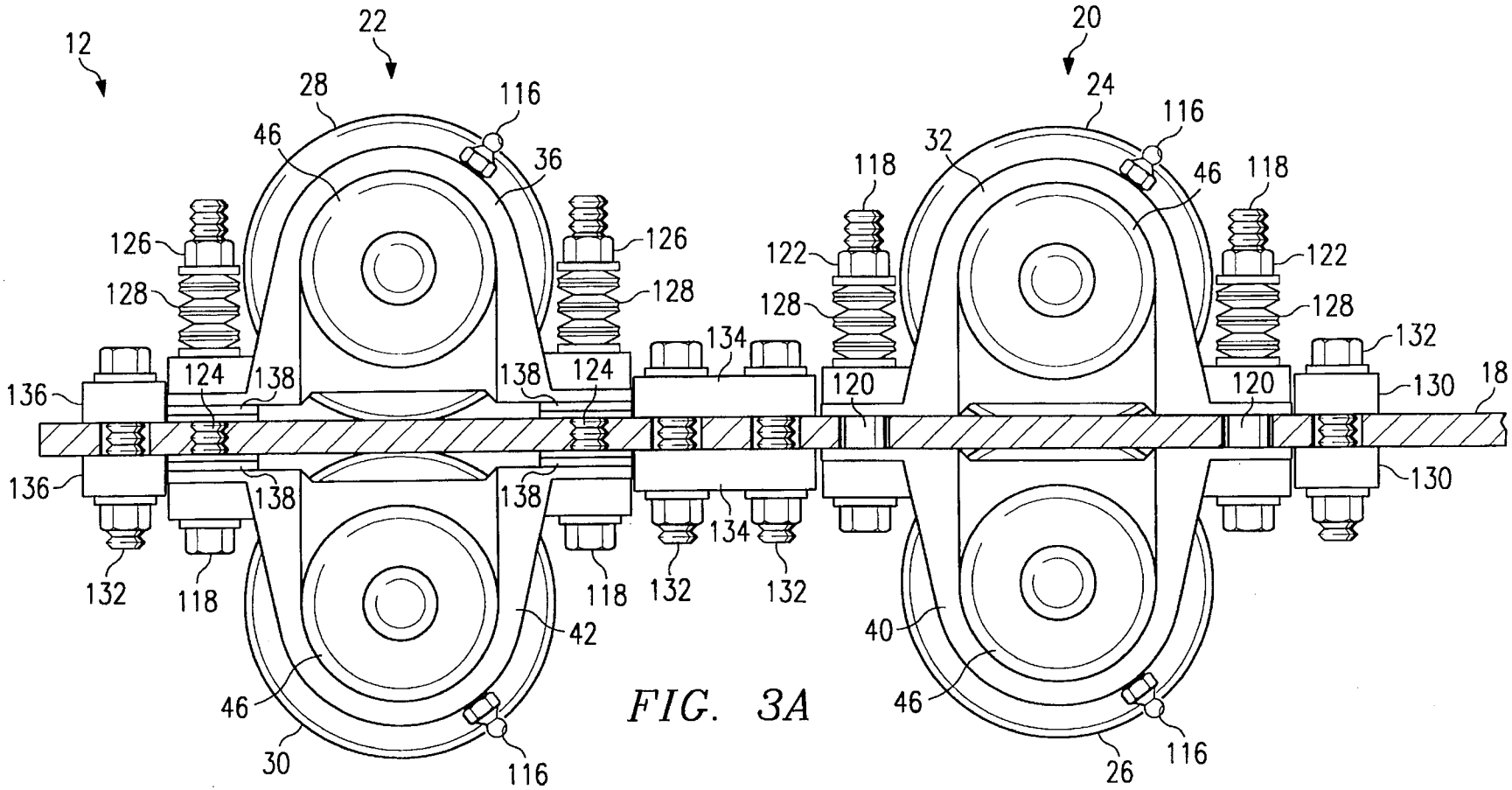
FIG. 3A illustrates a side view in elevation of the near side of the compression apparatus of FIG. 1.

FIG. 3A is a side view of compression apparatus 12 of FIG. 1 and provides additional detail for the mounting of rollers 20 and 22. FIG. 3A also illustrates one embodiment for providing elastic relief to clearances 96 and 98 between the rollers. Top in-take roller 24 is supported in roller housing 32 securing bearing 46 for top in-take roller 24. Bottom in-take roller 26 is supported by roller housing 40 securing bearing 46 for bottom in-take roller 26. In a similar manner, top out-take roller 28 is supported by roller housing 42 securing bearing 46 for top out-take roller 28. Bottom out-take roller 30 is supported by roller housing 42 securing bearing 46 for bottom out-take roller 30. Each roller housing may be embodied in a type of mounting hardware known commonly as a pillow block. Each bearing 46 may have grease fitting 116 for lubricating the bearing. Bearings 46 may be class A or class E type bearings. Flanged bearings, bearing cartridges in a housing, needle bearings, or other suitable bearings can all be used without departing from the concepts of the present invention. Additionally, bronze bushings may be a suitable embodiment for bearings 46.

Roller housings 32, 36, 40 and 42 are secured to support structure 18 by fastening hardware 118. In FIG. 3A, fastening hardware 118 securing in-take roller housings 32 and 40 are two sets of bolts 120 and nuts 122. Bolts 120 are threaded on their end only for mating with nut 122, but have their center portion without threads. Out-take roller housings 36 and 42 are secured to support structure 18 by bolts 124 and nuts 126. Bolts 124 are threaded along their entire shaft and engage support structure 18. This prevents any movement of bolts 124 with respect to support structure 18. Because bolts 120 are not threaded into support structure 18, they can move with respect to support structure 18. Both types of fastening hardware may be used to secure the roller housings to the support structure.

Compression apparatus 12 depicted in FIG. 3A also provides for relief of the clearance between a set of rollers. This is desirable to prevent jamming of compression apparatus 12 when a veneer slat having an irregularity, e.g. a knot, is fed into apparatus 12. If some relief is not provided, then compression apparatus 12 may jam stopping system 10.

Compression relief 128 is provided for each fastening hardware 118 securing a roller housing to support structure 18 in FIG. 3A. Belville washers are the preferred embodiment for compression relief 128 of FIG. 3A. When a slat having a knot or other irregularity is fed into compression apparatus 12 and the irregularity goes between a set of rollers, the rollers can move with respect to one another allowing the irregularity to pass. Depending on the mounting of the roller housings to support structure 18, either a top roller, a bottom roller, or both rollers can move with respect to support structure 18. Because threaded bolt 124 is used for out-take rollers 28 and 30, only top out-take roller 28 can move with respect to support structure 18. As the irregularity passes between rollers 28 and 30, compression relief 128 compresses allowing roller 28 to "jump" with respect to support structure 18. Since fastening hardware 118 uses bolt 120 that does not thread into support structure 18, either roller 24 or 26, or both of in-take rollers 20 can move with respect to support structure 18. When a slat with an irregularity passes between rollers 24 and 26, compression relief 128 compresses allowing the rollers to jump and the irregularity to pass.

Compression relief 128 allows an irregular thickness slat to processed through system 10 without jamming, stopping, or damaging system 10. It is noted that while Belville washers are the preferred embodiment for compression relief 128, that other forms of compression relief can be used without departing from the inventive concepts of the present invention. The number of Belville washers may also be varied to that depicted in FIG. 3A without departing from the concepts of the present invention.

Guides may also be required to ensure that the roller housings and rollers return their appropriate position following the passing of an irregular slat through compression apparatus 12. In-take guides or spacer blocks 130 are provided on the input of compression apparatus 12. Spacer blocks 130 are fixedly attached to structure 18 by mounting hardware 132. Between in-take rollers 20 and out-take rollers 22 are center spacer blocks 134 fixedly attached to structure 18 by mounting hardware 132. In a similar manner, out-take spacer blocks 136 are fixedly attached to support structure 18 by mounting hardware 132. Mounting hardware 132 may have many embodiments and in the preferred embodiment screws are used. Spacer blocks 130, 134 and 136 ensure that when a roller and its associated housing moves with respect to support structure 18, that it returns to the proper position. This prevents misalignment when one of the rollers moves to allow an irregular slat to pass.

FIG. 3A also shows one method for adjusting clearances 96 and 98 between rollers 20 and 22 respectively. Clearance 98 between out-take rollers 22 in FIG. 3A has been adjusted by using shims 138. Shims 138 placed between support structure 18 and roller housings 36 and 42 set clearance 98 between rollers 28 and 30. No shims have been used between support structure 18 and roller housings 32 and 40, leaving clearance 96 at its minimum value. In the preferred embodiment, shims 138 are made from metal.

Figure 3B:
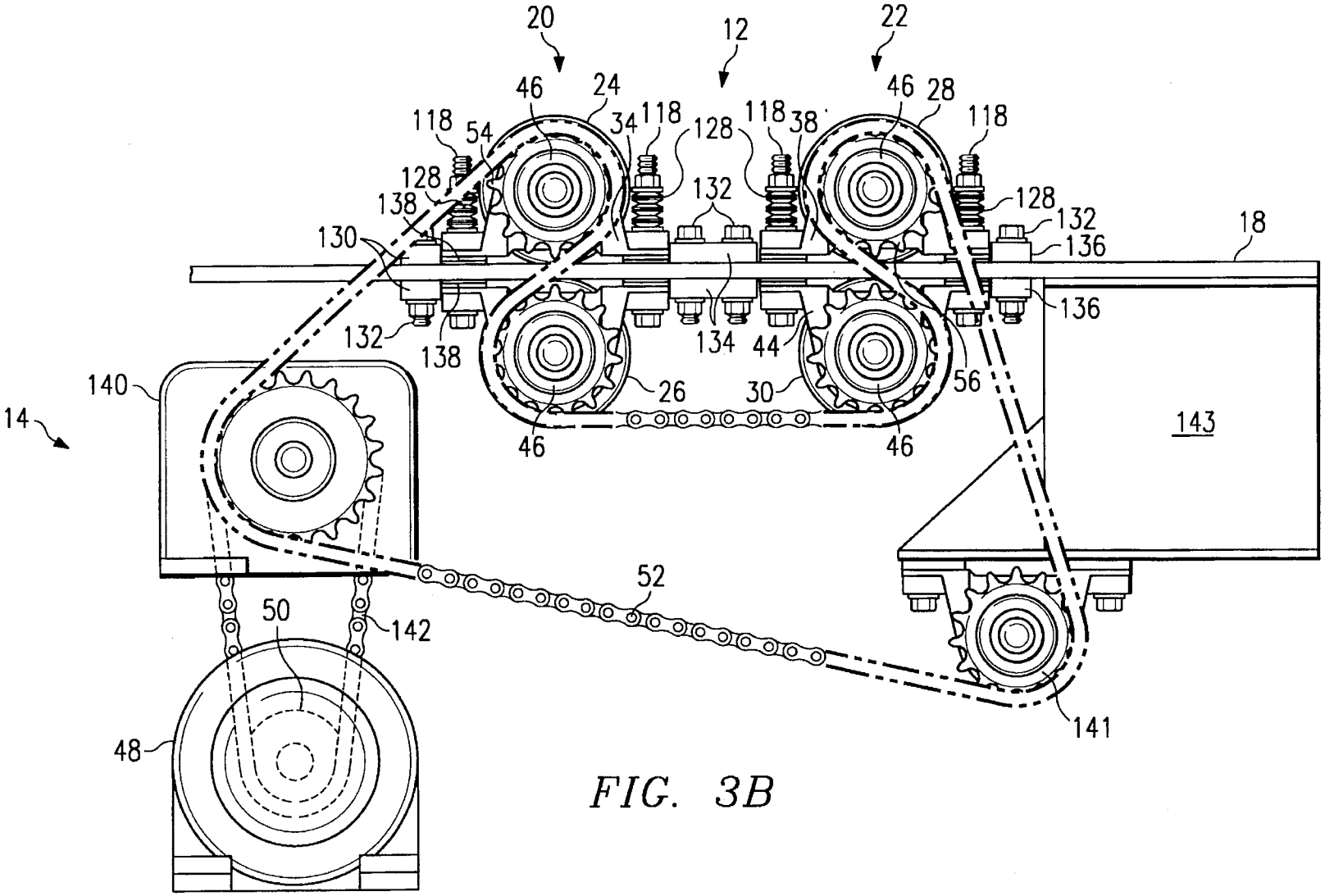
FIG. 3B shows the far side view of the compression apparatus of FIG. 1.

FIG. 3B provides a far side view of compression apparatus 12 and drive mechanism 14 of FIG. 1. Also shown in FIG. 3B is optional torque translator 140 that may be used to condition the force of motor 48 before it is applied by belt 142 to the rollers and feeder 16. Drive mechanism 14 may also include gear or sprocket 141 coupled to support 143 on support structure 18 to complete the loop of chain 52.

Each roller of compression apparatus 12 is driven by sprocket or gear 54. Chain 52 driven by motor 48 or torque translator 140 causes gears 54 on rollers 24, 26, 28 and 30 to turn at the same speed. A shear pin (not explicitly shown) may couple each gear 54 to its associated roller. Turning the rollers at the same speed insures that no longitudinal compression force is applied to a slat while in compression apparatus 12. Alternatively, it may be desirable to turn out-take rollers 22 slightly faster than in-take rollers 20 to ensure that compression apparatus 12 does not jam.

Figure 4:
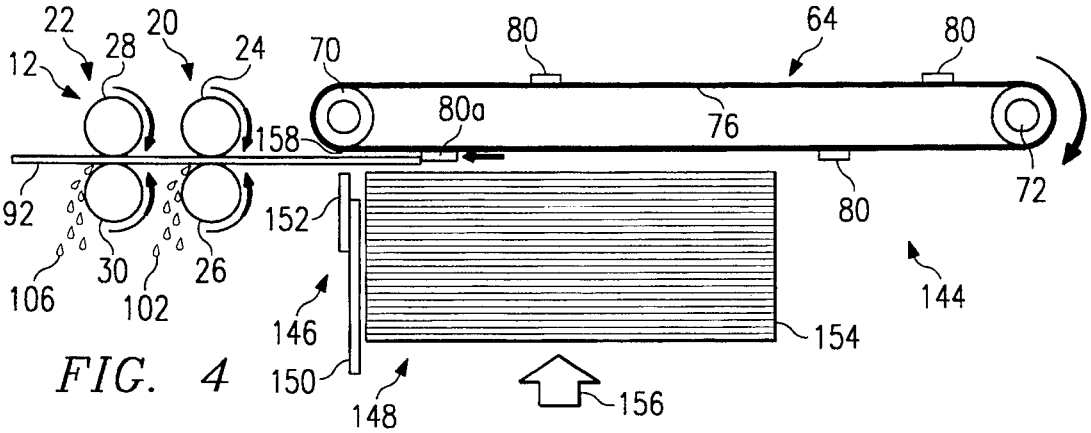
FIG. 4 depicts an alternate bottom-loading embodiment of the present veneer drying system.

FIG. 4 illustrates a side view of an alternate embodiment for the feeder used with veneer drying system of the present invention. Veneer drying system 144 of FIG. 4 includes compression apparatus 12 and belt system 64 from FIGS. 1 through 3B. Veneer drying system 144 also includes bottom loading feeder 146. Feeder 146 includes hopper 148, face plate 150, and bridge 152. A plurality of slats 154 are showed loaded into hopper 148 with upwards force 156 pushing slats 154 towards belt system 64. Upwards force 156 can be provided by techniques that are well known in the art.

The operation of veneer drying system 144 of FIG. 4 is very similar to veneer drying system 10 of FIG. 1. Slats 154 are loaded into hopper 148. Opening 158 between bridge 152 and belt system 64 and clearances 96 and 98 are set appropriately for the species and thickness of slats 154. Upwards force 156 moves slats 154 towards belt system 64. Lug 80*a* on belt system 64 engages the end of slat 92 forcing it into compression mechanism 12. Moisture 102 and 106 is compressed out of slat 92 resulting in a dried veneer slat.

Figure 5:
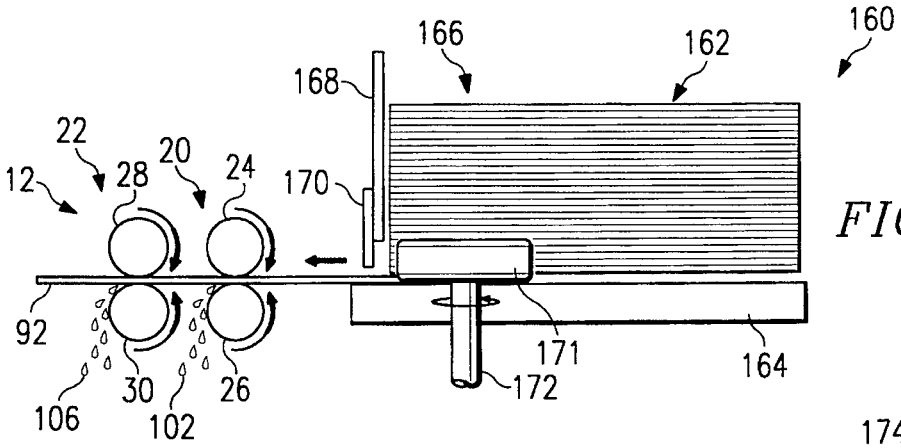
FIG. 5 shows an alternate embodiment of the present veneer drying system utilizing feed wheels.

FIG. 5 depicts a side view of veneer drying system 160, including compression apparatus 12 and an alternate configuration for the feeder. Feeder 162 includes support 164, hopper 166, face plate 168 and bridge 170. Feeder 162 is very similar to feeder 16 of FIGS. 1 and 2, with the noted exception that individual slats are fed into compression mechanism 12 by a pair of drive wheels 171 located on either side feeder 162. Drive wheels 171 may be made of a soft pliable material and engage the sides of a slat forcing it into compression mechanism 12. Drive wheels 171 are driven by axles 172 that are coupled to an appropriate power source (not explicitly shown). Axles 172 could be driven by the same power source used to drive rollers 20 and 22.

Figure 6:
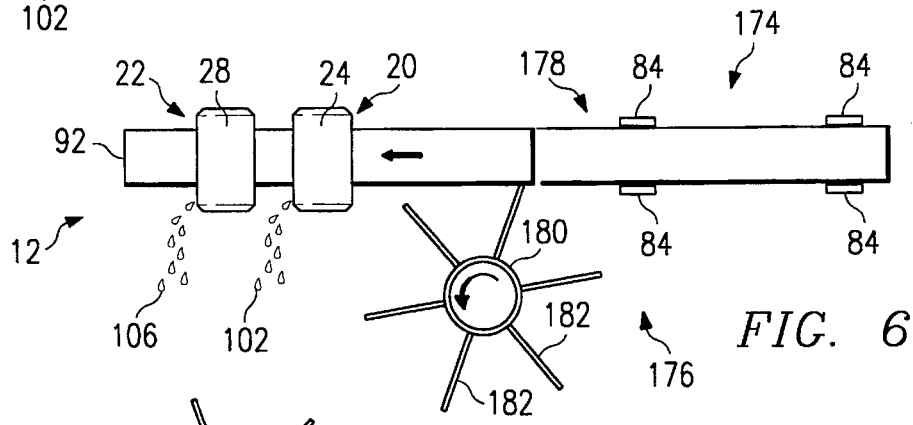
FIG. 6 illustrates a topical view of a wheel-loading embodiment of the present veneer drying system.

FIG. 6 depicts a top view of veneer drying system 174 depicting another embodiment of the present invention. Veneer drying system 174 includes compression apparatus 12 and feeder 176. Feeder 176 includes hopper 178 and wheel 180 having engagement fingers 182. Wheel 180 is rotated in the direction shown in FIG. 6 by an appropriate drive source, such as the motor turning rollers 20 and 22. Engagement fingers 182 of wheel 180 grab the bottom slat in hopper 178 feeding it into compression apparatus 12. The spacing of fingers 182 is set so that only a single slat 92 is fed into compression apparatus 92 at one time.

Figure 7:
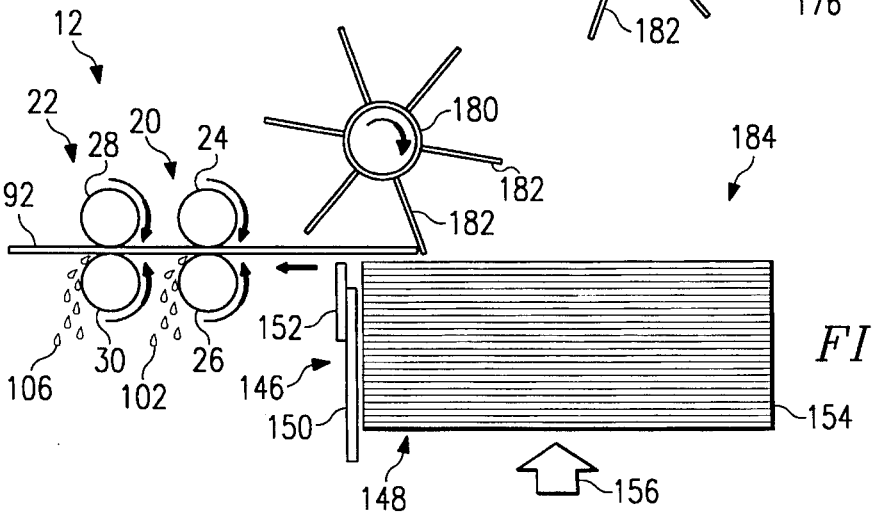
FIG. 7 depicts a bottom-loading wheel feed veneer drying system in accordance with concepts of the present invention.

FIG. 7 illustrates a side view of veneer drying system 184 embodying concepts of the present invention. System 184 is very similar to system 144 of FIG. 4 and system 174 of FIG. 6. System 184 includes compression apparatus 12 and hopper 148 of FIG. 4 with wheel 180 replacing belt system 64. Engagement fingers 182 on wheel 180 force single slat 92 into compression apparatus 12 where it is dried.

Figure 8:
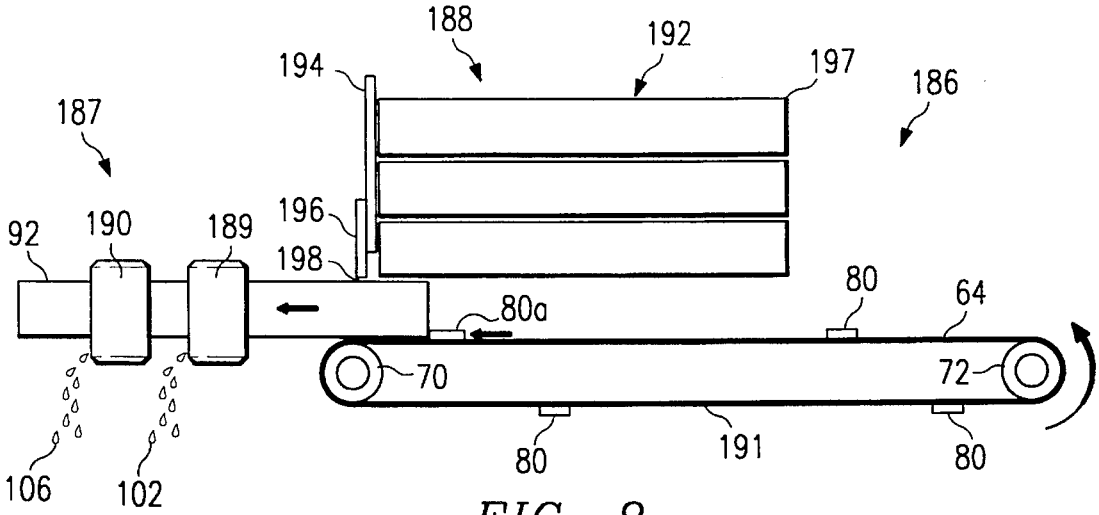
FIG. 8 shows an alternate embodiment of the present invention with the veneer slats fed on edge.

FIG. 8 shows a side view of veneer drying system 186 illustrating an alternate embodiment of the present invention. Veneer drying system 186 includes compression apparatus 187 and feeder 188. Compression apparatus 187 is similar to compression apparatus 10 previously described, but turned on its side. Compression apparatus 187 includes in-take rollers 189 and out-take rollers 190 each having a set of rollers that apply a compressive force to the slats. Feeder 188 includes belt system 191, hopper 192, face plate 194 and bridge 196. Belt system 191 is very similar to belt system 64 in FIG. 1. Hopper 192 is shown in FIG. 8 loaded with slats 197 stacked on edge. Opening 198 between bridge 196 and belt system 191 is set so that only a single slat 92 is fed into compression apparatus 187. Lugs 80 on belt system 191 engage slat 92 and force it into compression apparatus 187 where it is dried.

Figure 9:
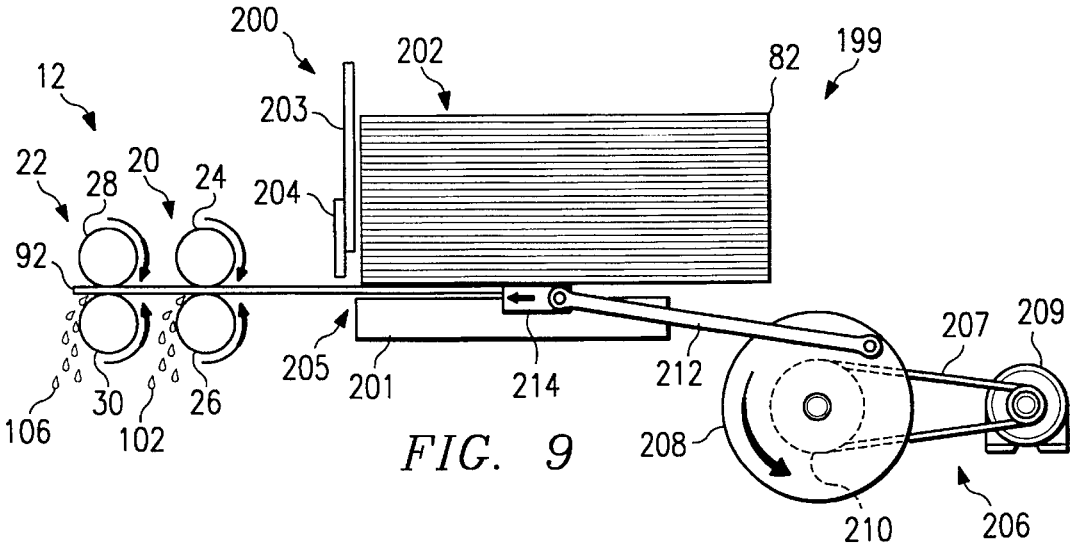
FIG. 9 shows an alternate embodiment of the present invention utilizing a piston feeder system.

FIG. 9 shows a side view of veneer drying system 199 illustrating an alternate embodiment of the present invention. Veneer drying system 199 includes compression apparatus 12 and feeder 200. Feeder 200 includes support structure 201, hopper 202, face plate 203, and bridge 204. Opening 205 between bridge 204 and support 201 is set so that only a single slat 92 is fed into compression apparatus 12. Feeder 200 also includes drive system 206 having motor 209, belt 207, wheel 208 and gear 210. Drive Motor 209 may be the same mechanism used to drive compression apparatus 12. Coupled to wheel 208 is arm 212 having knocker 214 attached thereto.

In operation of system 199, Motor 209 turns gear 210 and wheel 208 accordingly spins. Spinning wheel 208 moves arm 212 and knocker 214 causing veneer slat 92 to be forced into compression mechanism 12.

Figure 10:
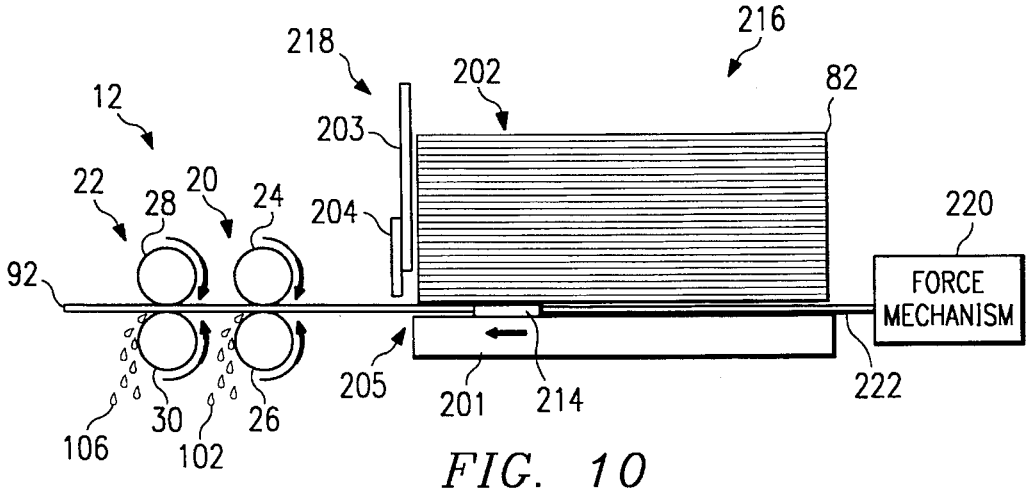
FIG. 10 illustrates an alternate embodiment of the present veneer drying system.

FIG. 10 illustrates veneer drying system 216 providing an alternate embodiment of the present invention. Veneer drying system 216 includes compression apparatus 12 and feeder 218. Feeder 218 includes hopper 202 loaded with veneer slats 82. Feeder 218 also includes force mechanism 220 that provides force 222 that inserts slat 92 into compression apparatus 12. Force mechanism 220 can have many suitable embodiments, including, for example, pneumatic or hydraulic machines, and electrical solenoid devices.

FIG. 11 illustrates a cross sectional view of an alternate embodiment for the rollers that may be used with the present invention. Roller 224 is a segmented roller having a plurality of sections 226. Each section can move with respect to each other section. The edges of each segment may also have bevelled surface 227 to allow the sections to move more easily with respect to one another. Roller 224 may also include shaft 228 that may be used to secure roller 224 to a roller housing. The ends of roller 224 may be covered by plates 230.

Using segmented roller 224 is another technique for providing compression relief to a veneer drying system in accordance with the present invention. By using segmented roller 224 in a compression apparatus, such as compression apparatus 12, an irregularity in a slat between two rollers 224 will be allowed to pass. When an irregularity strikes one of segments 226, e.g. segment 232, segment 232 will move with respect to the segments adjacent thereto. Once the irregularity passes, segment 232 will return to its original position among segments 226. It is also noted that larger irregularities may be accommodated with segmented roller 224, so that irregularities larger than a single segment can displace the needed number of segments so that the larger irregularity can pass.

FIGS. 12A and 12B illustrate several embodiments for the compression relief in segmented roller 224. FIG. 12A is a cross-sectional view of roller 234. Roller 234 contains shaft 228, having absorbing material 236 around shaft 228 but below segment wall 238. Absorbing material 236 may be embodied in a high density rubber or polymer that exhibits a high degree of elasticity and strength. Material 236 must compress and return to its original shape quickly so that the present veneer drying system operates properly.

Typical dimensions for the parts of roller 234 are shaft 228 having a diameter on the order of 1½ inches, roller 224 having a diameter on the order of 4½ inches, and segment wall 238 having a thickness on the order of ⅜ inches. The width of each segment along its face may be on the order to ⅝ inches. Segment wall 238 and shaft 228 may generally be formed from steel or other durable material. As previously noted, edge 239 of each segment may be bevelled. When using absorbing material 236, edge 239 should be bevelled so that it does not damage the absorbing material of an adjacent segment when the segments move with respect to one another.

FIG. 12 shows a cross-sectional view of segmented roller 240 that may be used in accordance with the present invention. Roller 240 includes shaft 228 and segment wall 238. Providing compression relief to roller 240 are a plurality of absorbers 242. Absorbers 242 may be embodied in springs, coils, or "S" springs. Absorbers 242 are distributed on radial axis of roller 240. In the configuration shown in FIG. 12B, absorbers 242 are at 60° spacings, it being understood that roller 240 is not limited to this spacing. Absorbers 240 allow segment wall 238 to compress with respect to shaft 228 so that an irregularity may pass through a compression apparatus employing with roller 240.

In operation of the present invention, a veneer slat has its moisture content significantly reduced by compressing the slat between two sets of rollers. The clearance between the first set of rollers is set to approximately one-half the initial thickness of the slat, and the clearance between the second set of rollers are set at slightly greater than the first set. Both sets of rollers are turned at essentially the same speed. As the slat is compressed in the first and second sets of rollers, moisture is discharged. The present invention incorporates an automatic feeder that allows multiple slats to be dried with minimal human involvement. The feeder systems may have several embodiments without departing from the concepts of the present invention.

The present invention provides several technical advantages. First, it can dry up to six slats per second as opposed to the half hour required with conventional oven drying techniques. The automated feeding system of the present invention minimizes the manpower required to dry veneer. The present invention is built form sturdy commonly available equipment and, therefore, is long lasting and requires relatively low capital investment.

Although the present invention has been described in detail, it should be understood that various changes, substitutions, and alterations can be made hereto without departing from the spirit and scope of the invention as defined by the appended claims.

What is claimed is:

1. An apparatus for processing veneer, comprising:

a first set of rollers turning at a first rate, the first roller set having a first clearance therebetween;

a second set of rollers turning at a second rate, the second roller set having a second clearance therebetween; and wherein the second roller set's turning rate is substantially equal to the fiat roller sees turning rate and wherein moisture is removed from the veneer by feeding the veneer into the first turning roller set and compressing the veneer to the first clearance in the first roller set and into the second turning roller set and compressing the veneer to the second clearance in the second roller set.

2. The apparatus of claim 1 wherein the first roller set further comprises a first roller and a second roller.

3. The apparatus of claim 1 wherein the second roller set further comprises a first roller and a second roller.

4. The apparatus of claim 1 wherein each roller of the first and second roller sets further comprises a segmented roller.

5. The apparatus of claim 1 wherein each roller of the first and second roller sets further comprises a solid metal roller.

6. The apparatus of claim 1 wherein each roller of the first and second roller sets further comprises;

a metal tube having first and second ends;

a shaft through a longitudinal axis of the metal tube; and plates fixedly attached to the ends of the metal tube for supporting the shaft with respect to the metal tube.

7. The apparatus of claim 1 further comprising:

roller housings for supporting the ends of each roller in the first and second roller sets; and a bearing associated with each roller and roller housing allowing each roller to rotate with respect to its associated roller housings.

8. The apparatus of claim 7 wherein each roller housing further comprises a pillow block.

9. The apparatus of claim 1 wherein the first clearance is substantially equal to the second clearance.

10. The apparatus of claim 1 wherein the first clearance is smaller than the second clearance.

11. The apparatus of claim 1 wherein the second roller set's turning rate is faster than the first roller set's turning rate.

12. The apparatus of claim i further comprising a motor for turning the first and second roller sets.

13. The apparatus of claim 1 further comprising compression relief associated with each roller set so that the clearance of each roller set can temporarily increase to allow a piece of veneer having an irregularity to pass between the rollers.

14. The apparatus of claim 13 wherein the compression relief further comprises glanville washers.

15. A method for processing veneer, comprising the steps of:

turning a first set of rollers at a first rate, the first roller set having a first clearance therebetween;

turning a second set of rollers at a second rate, the second roller set having a second clearance therebetween, and wherein the second roller sees turning rate is substantially equal to the first roller set's turning rate;

first feeding the veneer into the first turning roller set and compressing the veneer to the clearance in the first roller set so as to compress moisture out of the veneer; and second feeding the veneer into the second turning roller set and compressing the veneer to the clearance in the second roller set so as to compress moisture out of the veneer.

16. The method of claim 15 wherein the turning a first roller set step further comprises turning a first roller and a second roller at substantially the same speed but in opposite directions.

17. The method of claim 15 wherein the turning a second roller set step further comprises turning a first roller and a second roller at substantially the same speed but in opposite directions.

18. The method of claim 15 further comprising the step of setting the first clearance substantially equal to the second clearance.

19. The method of claim 15 further comprising the step of setting the first clearance smaller than the second clearance.

20. The method of claim 15 wherein the turning a first and second set of rollers steps further comprises turning the second roller set at a rate faster than the rate of the first roller set.

21. The method of claim 15 wherein the turning steps further comprise driving the rollers with a motor.

22. The method of claim 15 wherein the turning steps further comprise turning the rollers in each roller set at up to approximately 1600 RPM.

23. The method of claim 15 further comprising the step of providing compression relief for each roller set so that the clearance of each roller set can temporarily increase to allow a piece of veneer having an irregularity to pass between the rollers.

24. A system for processing veneer, comprising:

a compression apparatus, comprising, a first set of rollers turning at a first rate, the first roller set having a first clearance therebetween, and a second set of rollers turning at a second rate, the second roller set having a second clearance therebetween, and wherein the second roller set's turning rate is substantially equal to the tint roller sets turning rate;

a feeder comprising, a hopper for holding a plurality of veneer slats, and a feeder mechanism for feeding the slats one at a time into the compression apparatus;

a first drive mechanism for turning the first and second rollers; and a second drive mechanism for driving the feeder mechanism; and wherein moisture is removed from a veneer slat by feeding the veneer slat into the first turning roller set and compressing the veneer slat to the first clearance in the first roller set and into the second turning roller set and compressing the veneer slat to the second clearance in the second roller set.

25. The system of claim 24 wherein the first and second drive mechanisms are a single drive mechanism.

26. The system of claim 24 wherein the feeder mechanism further comprises a belt system comprising:

a belt driven by the drive mechanism; and a plurality of lugs coupled to the belt, the lugs operable to engage the slats in the hopper and guide them into the compression apparatus.

27. The system of claim 24 wherein the hopper further comprises a bridge defining an opening to the hopper for ensuring that slats are fed to the compression apparatus one at a time.

28. The system of claim 24 wherein the hopper is gravity fed.

29. The system of claim 24 further comprising a force mechanism for providing an upwards force to the slats in the hopper so that the slats are engaged by the belt system and fed into the compression apparatus.

30. The system of claim 24 wherein the feeder mechanism further comprises a turning feed wheel for contacting the sides of the slats in the hopper and for guiding the slats into the compression apparatus.

31. The system of claim 24 wherein the feeder mechanism further comprises a turning wheel having a plurality of engagement fingers for guiding the slats into the compression apparatus.

32. The system of claim 31 wherein the engagement fingers contact the side of the slats.

33. The system of claim 31 wherein the engagement fingers contact the top of the slats.

34. The system of claim 24 wherein the feeder mechanism further comprises a piston for guiding the slats into the compression apparatus.

35. The system of claim 34 wherein the feeder mechanism further comprises a belt driven by the drive mechanism, the belt further comprises a knocker coupled thereto for striking the piston.

36. The system of claim 34 further comprising a hydraulic force mechanism for driving the piston.

37. The system of claim 34 further comprising a pneumatic force mechanism for driving the piston.

38. The system of claim 34 further comprising an electrical solenoid for driving the piston.

39. The system of claim 24 wherein the first roller set further comprises a first roller and a second roller and the second roller set further comprises a first roller and a second roller.

40. The system of claim 24 wherein each roller of the first and second roller sets further comprises a segmented roller.

41. The system of claim 24 wherein the first clearance is substantially equal to the second clearance.

42. The system of claim 24 wherein the first clearance is smaller than the second clearance.

43. The system of claim 24 further comprising compression relief associated with each roller set so that the clearance of each roller set can temporarily increase to allow a piece of veneer having an irregularity to pass between the rollers.

44. A method for processing veneer, the method comprising the steps of:

loading a feeder with plurality of veneer slats;

turning a first set of rollers at a first rate, the first roller set having a first clearance therebetween;

turning a second set of rollers at a second rate, the second roller set having a second clearance therebetween, and wherein the second roller set's turning rate is substantially equal to the first roller set's turning rate;

automatically feeding the veneer slats from the feeder into the first turning roller set;

compressing each veneer slat to the clearance in the first roller set so as to compress moisture out of the veneer; and compressing each veneer slat to the clearance in the second roller set so as to compress moisture out of the veneer.

45. The method of claim 44 further comprising the step of setting an opening to the feeder so as to ensure that the slats are fed to the compression apparatus one at a time.

46. The method of claim 44 wherein the turning a first and second set of rollers steps further comprises turning a first roller and a second roller within each set at substantially the same speed but in opposite directions.

47. The method of claim 44 further comprising the step of setting the first clearance substantially equal to the second clearance.

48. The method of claim 44 further comprising the step of setting the first clearance smaller than the second clearance.

49. The method of claim 44 wherein the turning a first and second set of rollers steps further comprises turning the second roller set at a rate faster than the rate of the first roller set.

50. The method of claim 44 wherein the turning steps further comprise driving the rollers with a motor.

51. The method of claim 44 wherein the turning steps further comprise turning the rollers in each set of rollers at up to approximately 2000 RPM.

52. The method of claim 44 further comprising the step of providing compression relief for each roller set so that the clearance of each roller set can temporarily increase to allow a piece of veneer having an irregularity to pass between the rollers.

* * * * *